United States Patent [19]

Hoizumi et al.

[11] Patent Number: 4,693,086

[45] Date of Patent: Sep. 15, 1987

[54] STEAM TURBINE PLANT HAVING A TURBINE BYPASS SYSTEM

[75] Inventors: Shinichi Hoizumi, San Francisco, Calif.; Norio Abe; Takeshi Ueno; Tadao Arakawa, all of Hitachi; Kunio Hodozuka, Kure, all of Japan

[73] Assignee: Hitachi, Ltd., Tokyo, Japan

[21] Appl. No.: 787,106

[22] Filed: Oct. 15, 1985

[30] Foreign Application Priority Data

Oct. 15, 1984 [JP] Japan ..... 59-214372

[51] Int. Cl.[4] ..... F01K 13/02; F01K 7/24

[52] U.S. Cl. ..... 60/663; 60/679

[58] Field of Search ..... 60/663, 679

[56] References Cited

U.S. PATENT DOCUMENTS 3,105,357 10/1963 Vogler ..... 60/679 X
3,277,651 10/1966 Augsburger ..... 60/679 X
3,994,137 11/1976 Yasumoto et al. ..... 60/679 X

*Primary Examiner*—Allen M. Ostrager

*Attorney, Agent, or Firm*—Antonelli, Terry & Wands

[57] ABSTRACT

A reheat steam turbine power plant having a boiler with a superheater and reheater disposed therein, a high pressure steam turbine, an intermediate pressure steam turbine, a low pressure turbine, and a condenser condensing a steam exhausted through the low pressure turbine to a condensate. A turbine bypass pipe is provided with a bypass valve. A branch pipe branches off a cold reheater pipe between the check valve and the reheater is connected to the condenser for introducing steam flowing through the turbine bypass pipe. A control valve is arranged in the branch pipe and a controller controls the bypass valve and the control valve. When the turbine bypass line is operational in one of a start-up or an auxiliary operation of the power plant, the control valve and the bypass valve are controlled by the controller so that the quantity of reheat steam introduced into the reheater is controlled and excess or surplus steam is discharged to the condenser through the branch pipe.

6 Claims, 9 Drawing Figures

STEAM TURBINE PLANT HAVING A TURBINE BYPASS SYSTEM

BACKGROUND OF THE INVENTION

The present invention relates to a turbine plant and, more particularly, to a reheat steam turbine plant having a turbine bypass system which enables an improving of the operational characteristics of the turbine plant. In, for example, Japanese Patent Laid Open Application No. 26765/1984, a reheat steam turbine power plant is proposed including a turbine bypass system wherein an entire quantity of the steam, generated by the superheat of the boiler, is passed through a reheater of the boiler during a turbine bypass operation. The steam flows at a higher rate than the necessary flow rate for the reheater to be cooled so that a capacity of the turbine bypass system must be greater than otherwise required. However, it is uneconomical and ineffective to provide a large capacity for the turbine bypass system, since problems occur such as, for example, the passing of an unnecessarily large quantity of low temperature steam causes a delay in the temperature rise of the reheating steam when the power plant is started.

In, for example, "Modern Power Systems", July /Aug. 1983, a two stage reheat steam turbine power plant is proposed having a bypass system wherein the whole quantity or volume of steam generated by the superheater of the boiler, when passing through a first reheater and a second reheater, flows at a higher flow rate than the necessary flow rate for the reheaters to be cooled. Consequently, a disadvantage of this proposal resides in the fact that the capacity of the turbine bypass system must be larger than required. Thus, this proposed construction is also uneconomical and ineffective since it is necessary to provide a large capacity for the turbine bypass system. Additionally, in this proposed power plant, the temperature of the reheating steam cannot be quickly increased, so that a low temperature reheat steam is produced causing a delay in the start-up time of the power plant.

In, for example, Japanese Utility Model Laid Open Application No. 12604/1983, a two stage reheat steam turbine power plant is also proposed having a turbine bypass system, wherein the whole quantity of steam generated in the superheater flows into the reheaters through turbine bypass pipes, with the quantity of the reheat steam passed through the reheaters being increased by adding desuperheater water into the turbine bypass line for desuperheating the steam passing through the turbine bypass line. That is, the feed water to be added is turned into steam by a heat exchange with the high temperature steam passing through the turbine bypass pipes. During a start up operation of this proposes steam power plant, it is assumed that the quantity of steam generated in the superheater is 180 kg/sec, with the quantity of reheat steam passing through the first reheater reaching 200 kg/sec by adding the desuperheater water in the high pressure turbine bypass pipe, and the quantity of reheat steam passing through the second reheater reaches 220 kg/sec by adding the desuperheater water in the medium pressure turbine bypass pipe. By virtue of this arrangement, it takes more than forty minutes prior to the admission of steam into the steam turbine from the boiler ignition. Additionally, in Japanese Utility Model Laid Open Application No. 12604/1983, a further two stage reheat steam turbine power plant is proposed which includes a turbine bypass system, wherein both inlets of the first and second reheaters and outlets of the first and second reheaters are connected to each other by pipes. A disadvantage of this proposed construction resides in the fact that, in the operation of the turbine bypass system, it is difficult to control a valve located in a pipe line connecting an inlet and outlet of the first and second reheater without causing a temperature differential and pressure of the first and second cold reheating steam, and of the first and second hot reheating steam.

In Japanese Patent Publication No. 26765/1984, a turbine is proposed which includes a dump line connected from a cold reheat pipe to a condenser. However, the dump line is installed for maintaining a vacuum inside a high pressure turbine while the power plant is in an auxiliary operation, with the purpose of maintaining the vacuum inside the pressure turbine being to prevent the turbine blades from overheating which would be caused by a rotating of the turbine blades in air. While the dump line is a branch pipe of the cold reheat pipe, which is connected at an upstream side above a check valve attached on a cold reheat pipe, it is still not possible to reduce the capacity of the turbine bypass system by this proposed construction.

The aim underlying the present invention essentially resides in providing a steam turbine plant with a bypass system, wherein an arrangement is provided for enabling a control of the reheat steam through the reheater at an adequate range during operation of the turbine bypass system of the reheat steam turbine plant.

In accordance with advantageous features of the present invention, the heating of the reheat steam during the operation of the turbine bypass system is accelerated in order to reduce the starting time of the reheat steam turbine plant.

It is also possible in accordance with the present invention to accelerate the cooling of the reheat steam during the operation of the turbine bypass system in order to prevent an overheating of the reheat steam turbine.

In accordance with the present invention, a reheat steam turbine power plant is provided which includes a boiler having a superheater and a reheater therein, a turbine bypass system and means for regulating or controlling at least one of a steam flow rate or steam pressure, with the regulating or control means being adapted to control the steam flowing into the reheater at a suitable steam condition while the turbine bypass system is operating.

By virtue of the features of the present invention, it is possible to reduce the capacity of the turbine bypass system such that such capacity is less than the whole quantity of steam generated in the superheater, and to shorten the starting time of the reheat steam turbine power plant.

DETAILED DESCRIPTION

Figure 1A:
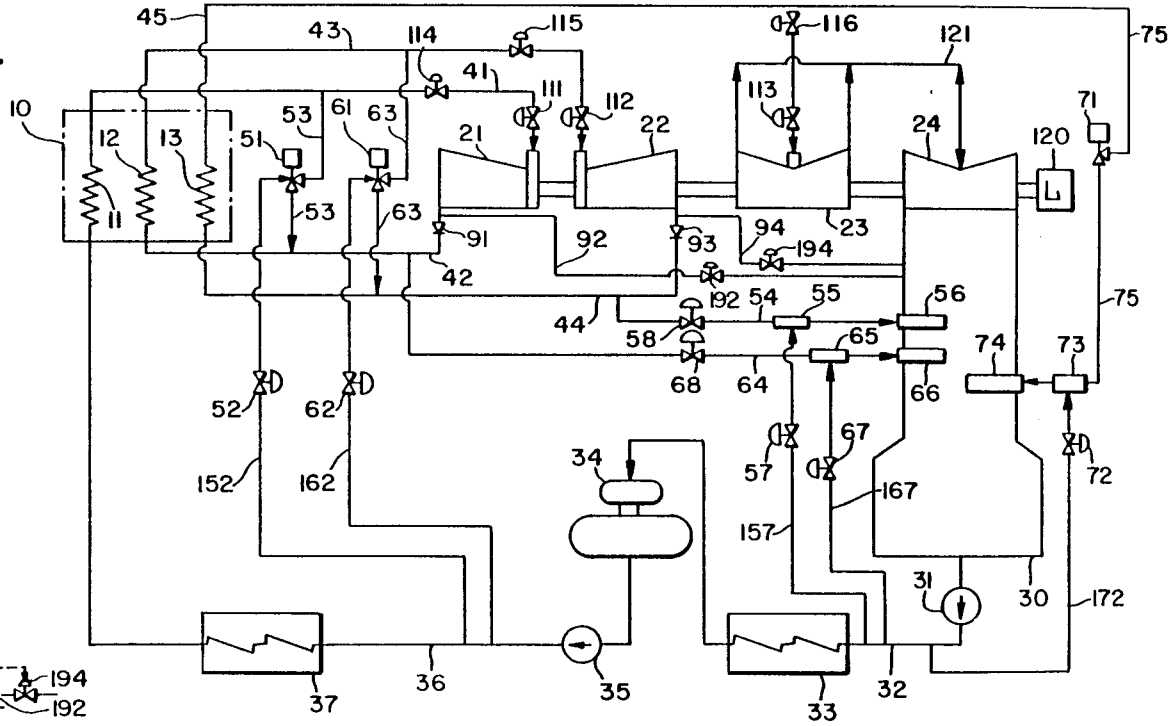
FIG. 1A is a schematic view of a two stage reheat steam turbine power plant having a turbine bypass system constructed in accordance with the present invention.

Referring now to the drawings wherein like reference numerals are used throughout the various views to designate like parts and, more particularly, to FIG. 1A, according to this figure, a two stage reheat steam turbine power plant includes a boiler 10, provided with a superheater 11, a first reheater 12 and a second reheater 13 therein. A main steam pipe 41, having a main stop valve 114 and control valve 111 therein, connects the outlet of the superheater 11 with an inlet of the high pressure turbine 21. Main steam generated in the superheater 11 flows into the high pressure turbine 21 through the main steam pipe 41. A first cold reheat pipe 42, having a check valve 91 therein, connects the outlet of the high pressure turbine 21 with an inlet of the first reheater 12.

A first hot reheat pipe 43 having a reheat stop valve 115 and a control valve 112 therein, connects the outlet of the first reheater with the inlet of the first reheat turbine 22. Reheat steam, generated in the first reheater 12, flows into the first reheat turbine 22 through the first hot reheat pipe 43. A second cold reheat pipe 44, having a check valve 93 therein, connects the outlet of the first reheat turbine 22 with an inlet of the second reheater 13. A second hot reheat pipe 45, having a stop valve 116 and control valve 113 therein connects the outlet of the second reheater 13 with the inlet of the second reheat turbine 23. Reheat steam generated in the second reheater 13 flows into the second reheat turbine 23 through the second hot reheat pipe 45. The steam passing from the second reheat turbine 23 flows into a low pressure turbine 24 through the pipe 121. The steam passing from the low pressure turbine 24 is exhausted or supplied into a condenser 30 and then the steam is condensed into a liquid condensate. The liquid condensate stored in the condenser 30 is fed to a deaerator 34 by a pump 31 through a low pressure condensate pipe 32 having a low pressure heat exchanger 33. The liquid condensate, deaerated in the deaerator 34, is fed to the boiler 10 by a pumping action of a feed water pump 35 through a high pressure condenser 36 having a high pressure heat exchanger 37.

A high pressure turbine bypass pipe 53 connects the main stream pipe 41 with the first cold reheat pipe 42, and a high pressure turbine bypass valve 51, provided in the turbine bypass line 53, controls the rate of flow of the steam.

In a similar manner, an intermediate pressure bypass pipe 63, having an intermediate pressure turbine bypass valve 61, connects the first hot reheat pipe 43 with the second cold reheat pipe 44.

A low pressure turbine bypass pipe 75, having a low pressure turbine bypass valve 71, discharges the steam from the second hot reheat pipe 45 to the condenser 30 so as to form a turbine bypass system. A load 20 is provided, which load is driven by the turbines 21–24.

With a turbine bypass system constructed in accordance with FIG. 1, two steam discharge pipes 64, 54 are provided. The discharge pipe 64 branches off on a downstream side of the check valve 91 on the first cold reheat pipe 42 to the condenser 30 for the purpose of discharging a portion of the stream flowing through the high pressure turbine bypass pipe 53. The discharge pipe 54 branches from a downstream side of the check valve 93 in the second cold reheat pipe 44 to the condenser for discharging a portion of the steam flowing through the intermediate pressure turbine bypass pipe 63. With regard to the steam discharge pipes 64 and 54, which respectively, in the embodiment of FIG. 1, branch off the first cold reheat pipe 42 and second cold reheat pipe 44, it is also possible, in accordance with the present invention to connect the steam discharge pipes to the pipe of the first reheater 12 and second reheater 13 or in a vicinity or zone thereof.

Figure 1B:
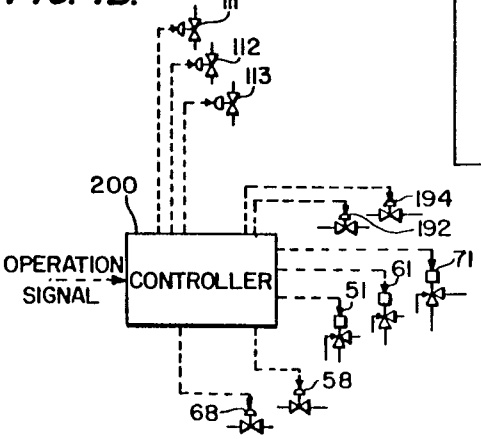
FIG. 1B is a schematic view of a control arrangement for the valves of the system of FIG. 1A.

The regulating valves 58, 68, disposed in the discharge pipe 64, 54, control the quantity of steam discharged into the condenser 30, with the regulating valves 58, 68 being operated as shown most clearly in FIG. 1B by a controller 200, when the turbine bypass system becomes operational. Consequently, the quantity or volume of steam necessary for cooling the first reheater 12 and the second reheater 13 of the boiler 10 is admitted through the turbine bypass pipes 53, 63, since excess steam is respectfully discharged to the condenser through the steam discharge pipes 64, 54 during a start-up operation of the turbine plant or in an auxiliary operation, that is, when the turbine bypass system of the turbine plant becomes operational.

Moreover, the steam discharge pipes 54, 64 include desuperheaters 55, 65 for enabling a setting of a temperature of steam within an appropriate or predetermined range. Two branch pipes 157, 167, having control valves 57, 67 therein respectively connect the low pressure condensate pipe 32 with the desuperheaters 55, 65. The temperature of steam in the desuperheaters 55, 65 is regulated at the setting or predetermined temperature by the control valves 58, 68 which control the flow rate or volume of the low temperature liquid condensate introduced through the branch pipes 157, 167.

In a similar manner, the low temperature liquid condensate is fed to a desuperheater 73 through a branch pipe 172 provided with a control valve 72, which is provided in the low pressure turbine bypass pipe 75. Branch pipes 152, 162, including control valves 52, 62, respectively feed the liquid condensate, i.e., water, from the high pressure condensate pipe 36 to the high pressure turbine bypass valve 51 and the intermediate pressure turbine bypass valve 61. The condenser 30 is provided with an energy damper 56, 66, 74, which are connected to the steam discharge pipes 54, 64 and the low pressure turbine bypass pipe 75. A dump or discharge pipe 92, including a valve 192 branches off the first cold reheat pipe 42 between the check valve 91 and the outlet of the high pressure steam turbine 21 and is connected to the condenser 30. Another dump or discharge pipe 94, provided with a valve 194, branches off the second cold reheat pipe 44 between the check valve 93 and the outlet of the first reheat turbine 22, and is connected to the condenser 30.

When the steam power plant is transferred from an ordinary operation to a turbine bypass operation, such as an auxiliary load operation, main steam generated in the superheater 11 and the reheat steam generated in the first reheater 12 are prevented from flowing into the high pressure turbine 21 and the first reheater turbine 22 by a closing or shutting off of the valve 114, 115, and then this steam is introduced to the turbine bypass line 53, 63 through the bypass valves 51, 61. At this time, reheat steam passed through the second reheater 13 flows into and drives the second reheat turbine 23 and the flow pressure turbine, so that the high pressure turbine 21 and the first reheat turbine 22 are rotated by virtue of a driving of the turbines 23, 24, which, would result in a rotation of the buckets thereof in the atmosphere or air. Consequently, it is necessary to maintain a vacuum inside the high pressure turbine 21 and the first reheat turbine 22 so as to prevent the same from overheating while the steam power plant is in operation during an auxiliary load operation, and additionally so that the steam inside the turbines 21, 22 is discharged to the condenser 30 through the dump or discharge pipe 92, 94 by operation of the valves 192, 194.

A two stage reheat steam power plant described above operates in the following manner:

During an ordinary operation of the steam power plant, steam generated in the superheater 11, first reheater 12, and second reheater 13 is introduced through the pipes 41, 43, 45 and 121 respectively and drive the turbines 21, 22, 23, 24. The valves installed in the turbine bypass pipes 53, 63, 75, the steam discharge pipes 54, 64, and the dump pipes 92, 94 are shut off, and steam is thereby prevented from flowing through these pipes during the ordinary operation.

When the bypass operation is effective, such as, for example, when an accident may occur in the power transmission system or the like, the steam power plant is operated to reduce the load level to a minimum load level which is sufficient to drive the auxiliary equipment such as the boiler feed pump 35, etc. This minimum load level is about 5–9% of the maximum load level and, consequently, is designated as an auxiliary load operation.

During an auxiliary load operation, the minimum load is compensated for by driving the second reheat turbine 23 and the low pressure turbine 24, with both the main stop valve 114, in the main steam pipe 41, and the reheat stop valve 115 in the first hot reheat pipe 43, being shut off by operation signals from the controller 200 so as to prevent the steam from flowing into the pressure turbine 21 and the first reheat turbine 22. Simultaneously, both the bypass valve 51, in the high pressure bypass pipe 53, and the bypass valve 61 in the intermediate bypass pipe 63, are opened as a result of output or operation signals from the controller 200 so as to enable an introduction of steam generated into the superheater 11 and the first reheater 12 into the high pressure turbine bypass pipe 53 and the intermediate turbine bypass pipe 63, respectively.

The necessary quantity of reheat steam for cooling the first reheater 12 is introduced into the first reheater 12 through the high pressure turbine bypass 53 and the first cold reheat pipe 42. The excess reheat steam for the first reheater 12 is discharged into the condenser 30 through the steam discharge pipe 64, branched off the high pressure turbine bypass 53, since, if the whole quantity of the high temperature steam flows into the first reheater 12, the reheater 12 would overheat. In a similar manner, the necessary quantity or volume of reheat steam for cooling the second reheater 13 is introduced into the second reheater 13 through the intermediate pressure turbine bypass line 63 and the second cold reheat pipe 44, an excess reheat steam is discharged into the condenser 30 through the steam discharge pipe 54, branching off the intermediate pressure turbine bypass pipe 63.

In the above described turbine bypass operation, a flow of motive steam into the high pressure turbine 21 and first reheat turbine 22 is interrupted, and the second reheat turbine 23 and low pressure turbine 24 are driven by the motive steam. As noted above, it is necessary to maintain a vacuum inside the high pressure turbine 21 and first reheat turbine 22 in order to prevent the turbines from overheating; therefore, air inside the turbines 21, 22 is discharged into the condenser 30 through the dump or discharge pipes 92, 94 by opening the valves 192, 194. At that time, the flow of the motive steam into the turbines 21, 22 is interrupted in reverse by the check valves 192, 194, from the cold reheat pipes 42, 44 to the dump or discharge pipes 92, 94.

A portion of the feed water flowing in the high pressure condensate pipe 36 is introduced to the high pressure turbine bypass valve 51 and the intermediate pressure turbine bypass valve 61 through the pipes 152, 162, respectively, in order to reduce the temperature of the steam to within a suitable range, which flows into the first reheater 12 and the second reheater 13. A portion of the feed water flowing in the low pressure condensate pipe 32 is introduced into the desuperheaters 55, 65, provided in the steam discharge pipes 54, 64 through the pipes 157, 167, respectively, in order to reduce the temperature of the steam into the suitable or necessary range, flows into the condenser 30.

During an auxiliary operation of the steam power plant, the necessary generating quantity of steam cooling the reheaters 12, 13 is provided for the reheaters 12, 13 through the turbine bypass pipes 53, 63 and the cold reheat pipes 42, 44, with the excess quantity of steam for cooling the reheaters 12, 13 being discharged into the condenser 30 through the steam discharge pipes 54, 64. Consequently, the quantity or volume of the reheat steam and the temperature of the reheat steam flowing through the respective reheaters, controls the necessary ranges so that it facilitates an auxiliary operation of the steam power plant. By virtue of this arrangement, it is possible to provide a compact capacity turbine bypass system for the reheat stage steam turbine power plant.

With regard to a start-up operation of the steam power plant, the boiler 10 is unable to provide the motive or driving steam to a level necessary for the steam condition to be able to drive the steam turbines in an early stage. Consequently, at first, the control valves 111, 112 and 113 are closed by the operation signal from the controller 200 (FIG. 1B) in order to prevent the steam turbines 21–24 from being damaged by the introduction of cold steam into the steam turbine until the motive or drive steam is increased to a sufficient level to ensure driving thereof. Secondly, the high pressure turbine by-pass valve 51 is opened by the controller 200 to introduce the motive or drive steam, generated in the superheater 11 of the boiler, to the first reheater 12 through the high pressure turbine bypass pipe 53 and the first cold reheat pipe 42. The necessary quantity of the steam for reheating the first reheater 12 is controlled by the operation of the bypass valve 51, and excess steam for the first reheater is discharged into the condenser 30 through the operation of the valve 68 through the steam discharge pipe 64. Simultaneously, the steam reheated in the first reheater 12 of the boiler is introduced into the second reheater 13 through the medium pressure bypass pipe 63 and the second cold reheat pipe 44.

The necessary quantity or volume of reheat steam for reheating the second reheater 13 is controlled by the operation of the bypass valve 61, and excess reheat steam is discharged into the condenser 30 by operation of the valve 58 through the steam discharge pipe 54. The reheat steam reheated in the second reheater 13 is discharged into the condenser 30 through the low pressure turbine bypass pipe 75 until the reheat steam is increased to a sufficient level to drive the second reheat turbine 23 and the low pressure turbine 24. It is possible to increase the reheat steam flowing into the first and second reheater 12, 13 at a sufficient level or condition earlier by controlling the operation of the valves 51, 61, 58, 68 in a manner described hereinabove. When the motive or drive and reheat steam are heated up to a sufficient condition, the control valves 111, 112, 113, are opened gradually by the controller 200, of a conventional construction, in order to introduce this steam into the high pressure turbine 21, first reheat turbine 22, second rehet turbine 23, low pressure turbine 24, and the bypass valves 51, 61, disposed in the turbine bypass lines 53, 63, and the valves 58, 68, disposed in the discharge pipes 54, 64, are closed gradually by the controller 200. Consequently, the steam turbines are then driven, thereby accomplishing a start-up operation of the two stage reheat steam turbine power plant. In the system described in connection with FIGS. 1A and 1B, the required or necessary quantity of steam to flow into the reheater is determined to be at most 20–30% of the full load condition which is capable of preventing the reheater from overheating.

Figure 2:
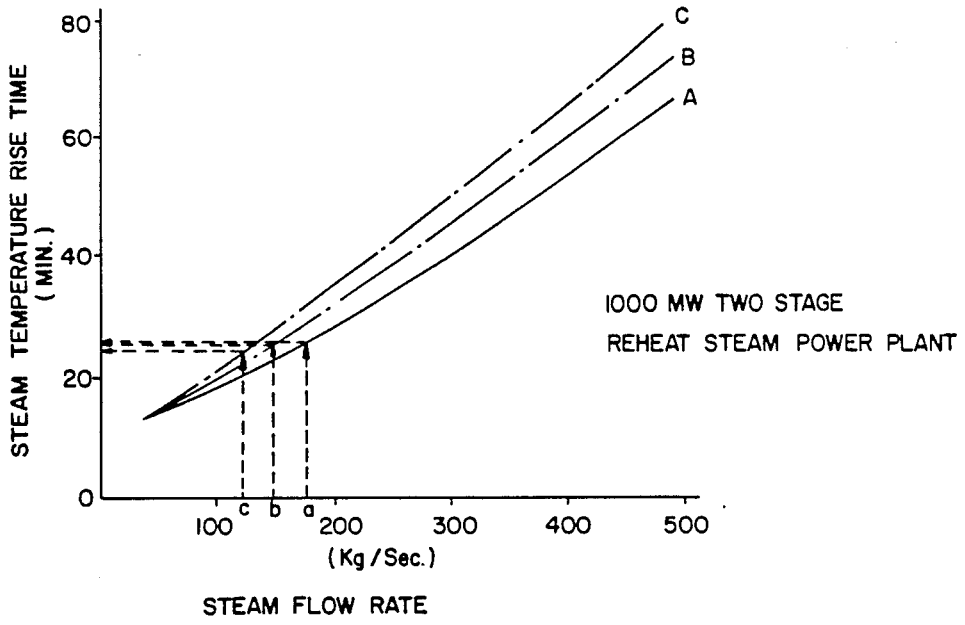
FIG. 2 is a graphical illustration of a relationship between a flow and temperature rise time period at a start up or auxiliary operation of the steam power plant of FIG. 1.

FIG. 2 graphically illustrates a relationship between the temperature rise of the steam and the steam flow rate of the reheat steam power plant of FIG. 1. In FIG. 2, the lines A, B and C respectively show the main steam generated in the superheater 11, the first reheat steam flowing into the second reheater 13. During, for example, a start-up operation a quantity of the steam generated in the superheater 11 is assumed to have a flow rate of 180 kg/sec as indicated by the reference character a. A quantity or volume of reheat steam flowing into the first reheater 12 through the high pressure turbine bypass pipe 53 is reduced to a flow rate of 150 kg/sec as indicated by the reference character b. Access reheat steam of, for example, 30 kg/sec and generated steam caused by the heat exchange between the reheat steam and the feedwater to be introduced for desuperheating the reheat steam are discharged into the condenser 30 through the steam discharge pipe 64. A quantity of reheat steam flowing into the second reheater 13 through the medium pressure turbine bypass pipe 63 is reduced to a flow rate of 120 kg/sec as indicated by the reference character c.

Excess reheat steam of, for example, 30 kg/sec and a generated steam caused by the heat exchange between the reheat steam and the feed water to be introduced for desuperheating the reheat steam are discharged into the condenser 30 through the steam discharge pipe 54. By this arrangement, it is possible to supply an appropriate quantity or volume of steam into the first reheater 12 and the second reheater 13, respectively, thereby preventing the reheaters 12, 13 from overheating during a start-up operation and thereby enabling an accelerating of the warming up of the reheaters 12, 13.

In comparison to Japanese Utility Model Laid Open Application No. 12604/9183, the quantity of steam flowing into the first reheater 12 is decreased by about 25%, and the quantity of steam flowing into the second reheater 13 is decreased by about 45%, so that the capacity of the turbine bypass system in the steam power plant of the present invention can be manufactured on a relatively small scale. Thus, it is possible to reduce a starting time from boiler ignition to steam admission into the steam turbine to less than thirty minutes, which is about ten minutes less than the starting time of prior art construction.

In the connection, thermal power plants are presently required to start and stop daily and, since the number of nuculear plants has increased, a reduction in the starting time is necessary to meet daily demands. It is presently required that the starting time of a thermal power plant following an eight hour suspension of operation should be between 150–160 minutes in a coal-fired plant and about 100–120 minutes in an oil or gas-fired plant. Thus, the fact that the necessary starting time can be reduced to about ten minutes by applying the turbine bypass system of the present invention is quite significant.

Figure 3A:
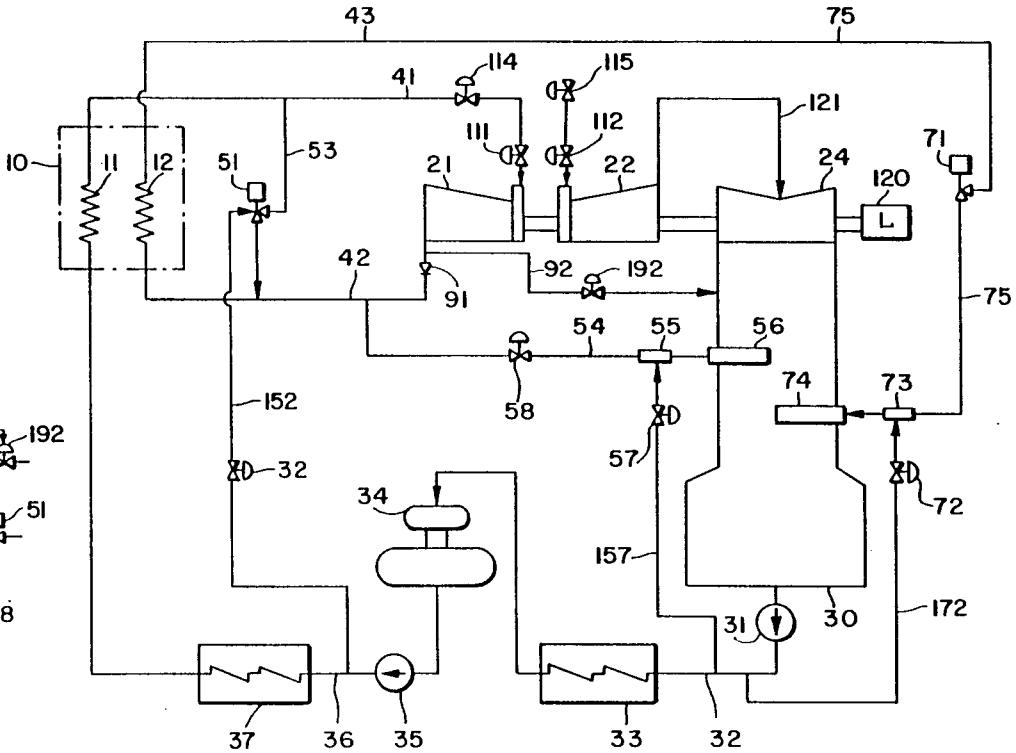
FIG. 3A is a schematic view of a one stage reheat steam turbine power plant having a turbine bypass system constructed in accordance with the present invention.

As shown in FIG. 3A, a single stage reheat steam turbine plant includes a steam discharge pipe 54, a valve 58, a high pressure turbine bypass 53, a bypass valve 51, a dump or discharge pipe 92, and desuperheated water regulating valves 52, 57. Since the bypass system of FIG. 3A is applied to a single stage steam reheat turbine, it does not include a second reheater 13, a medium pressure turbine bypass pipe 63, a dump or discharge pipe 92, and the second steam discharge pipe 64 and associated equipment attached to the pipes but the system of FIG. 3A is nevertheless able to realize the same operation and effect as in the system of FIGS. 1A, 1B.

Figure 3B:
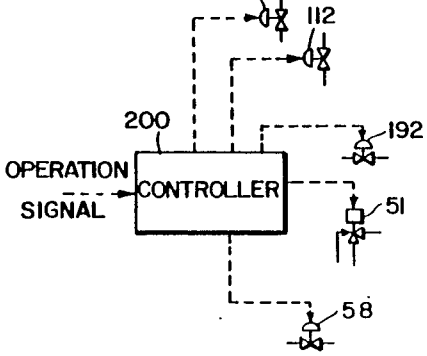
FIG. 3B is a schematic view of a control arrangement for the power plant of FIG. 3A.

As shown in FIG. 3B, a controller 200, of conventional construction, as in the previous embodiment, is responsive to an operation signal for controlling the operation of the valves 111, 112, 192, 51 and 58.

Figure 4A:
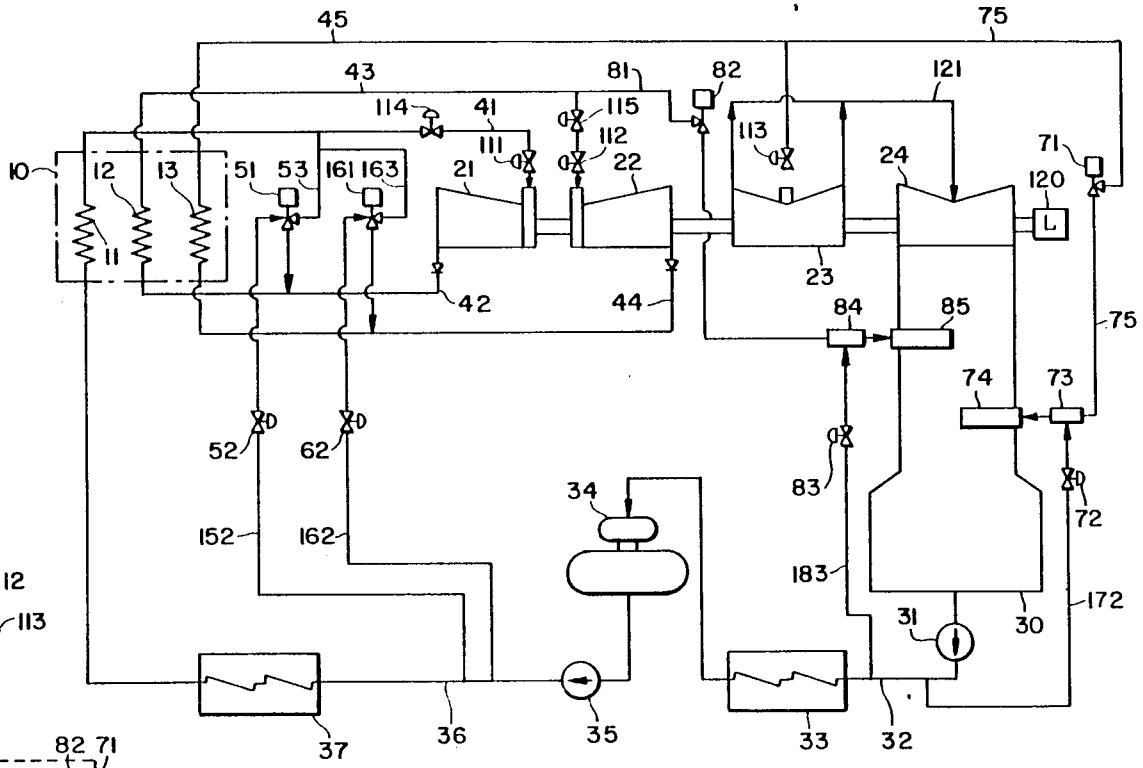
FIG. 4A is a schematic view of another embodiment of a two stage reheat steam turbine power plant having a bypass system constructed in accordance with the present invention.

As shown in FIG. 4A, a two stage reheat steam turbine is provided which differs from the embodiment described in FIGS. 1A, 1B by a provision of a second high pressure turbine bypass pipe 163 having a second high pressure turbine bypass valve 161 instead of the medium pressure turbine bypass pipe 63 with the bypass valve 61. The second high pressure turbine bypass pipe 163 connects the upstream portion of the bypass valve 51 from the bypass valve 51 in the high pressure turbine bypass pipe 53, with the second cold reheat steam pipe 44. The intermediate pressure turbine bypass pipe 81 branches off from the first reheat steam pipe 43 and is connected with the condenser 30, with the turbine bypass pipe being provided with an intermediate pressure turbine bypass valve 82, desuperheater 84, and energy damper 85.

Figure 4B:
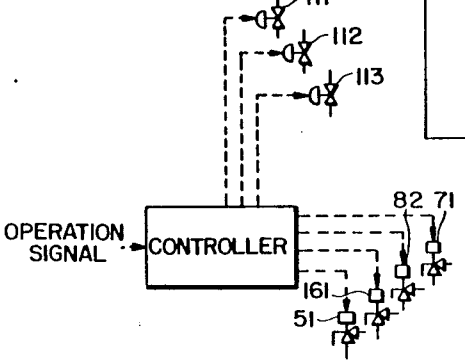
FIG. 4B is a schematic view of a control arrangement for the valves of the system of FIG. 4A.

When the turbine bypass system of FIGS. 4A and 4B is in operation, the steam generated in the superheater 11 of the boiler 10 is led through the main steam pipe 41 and is diverted into the first high pressure turbine bypass pipe 53 and the second high pressure turbine bypass 163. One portion of the diverted steam flows into the first reheater 12, with the necessary or predetermined quantity of the steam through the first high pressure turbine bypass pipe being controlled by the bypass valve 51, and then the diverted steam is discharged into the condenser 30 through the first reheat pipe 43 and the intermediate pressure turbine bypass pipe 81. The other portion of the diverted steam flows into the second reheater 13 at a sufficient or necessary quantity or volume for warming thereof through the second high pressure turbine bypass pipe 163 by controlling the bypass valve 61, and then the diverted steam is discharged into the condenser 30 through the second hot reheat pipe 45 and low pressure turbine bypass pipe 75. That is, by applying the above described turbine bypass system, it is possible to reduce the quantity or volume of steam passing through the first and second reheaters 12, 13 of the boiler 10, and to improve the temperature rise characteristics of the reheat steam since the steam generated in the superheater is lead into the first reheater 12 and the second reheater 13 in a diverting manner.

Thus, the above described turbine bypass system is also effective in reducing the starting time so that it is possible to shorten the starting time by about five minutes as compared with conventional systems.

As with the previous embodiments, as shown in FIG. 4B, a conventional controller 200, responsive to an operation signal, controls the operation of the valves 111–113 as well as the valves 51, 71, 82, 161 during operation of the power plant system.

Figure 5A:
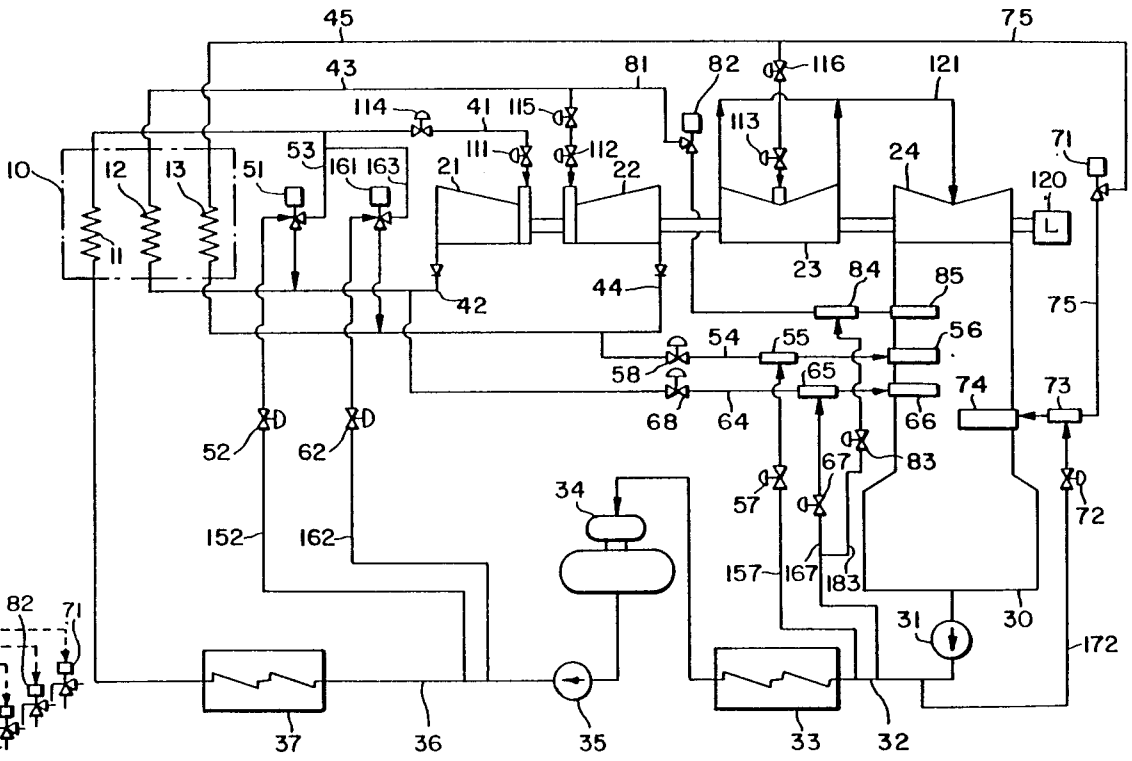
FIG. 5A is a schematic view of yet another embodiment of a two stage reheat steam turbine plant having a bypass system constructed in accordance with the present invention.
Figure 5B:
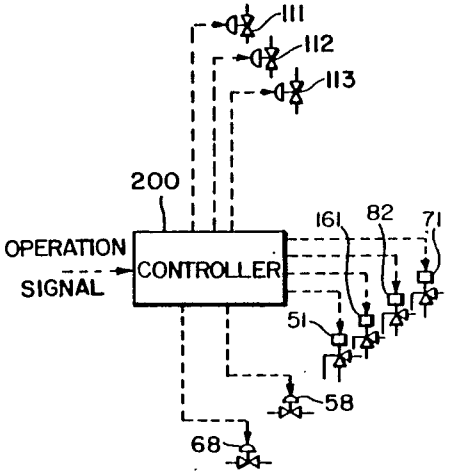
FIG. 5B is a schematic view of a control arrangement for the valves of the power plant of FIG. 5A.

The embodiment of FIG. 5 represents a two stage reheat steam turbine power plant of the type similar to that shown in FIG. 4, having steam discharge pipes 54, 64, control valves 58, 68, desuperheaters 55, 65, and associated equipment attached thereto in the manner shown and described in connection with the embodiment of FIG. 1. The turbine bypass system of the embodiment illustrated in FIGS. 5A and 5B has a similar effect and operation to that of the other embodiments described hereinabove. In this connection, as shown in FIG. 5B, an operation signal is supplied to a controller 200 for controlling the operation of the valves 111–113, 51, 58, 68, 71, 82, and 161 so as to control the operation of the power plant system.

As evident from the above detailed description, the steam turbine plant of the present invention ensures that only the necessary quantity of steam passes through the reheater of the boiler and, consequently, while the turbine bypass system is in operation at a start-up or during an auxiliary load operation, the construction of the present invention greatly contributes to improvements in the economy of a steam turbine plant and operational practicability.

While we have shown and described several embodiments in accordance with the present invention, it is understood that the same is not limited thereto but is susceptible to numerous changes and modifications as known to one having ordinary skill in the art, and we therefore do not wish to be limited to the details shown and described herein, but intend to cover all such modifications as are encompassed by the scope of the appended claims.

We claim:

1. A reheat steam turbine power plant including a turbine bypass system, the power plant comprising: a boiler having a superheater and a reheater therein, a high pressure steam turbine driven by steam generated in the superheater and supplied through a main steam pipe, a first control valve means for controlling a flow of the steam through the main steam pipe, a reheat steam turbine driven by reheat steam heated up in the reheater and conducted through a hot reheat steam pipe, a second control valve means for controlling a flow of steam through the hot reheat steam pipe, a condenser for condensing the reheat steam exhausted from the reheat steam turbine, a cold reheat steam pipe connecting an outlet of the high pressure steam turbine with an inlet of the reheater, a check valve means disposed in the cold reheat steam pipe, a condensate pipe means for connecting the condenser with an upstream side of the superheater, a high pressure turbine bypass pipe means for connecting the main steam pipe with the cold reheat steam pipe, a turbine bypass valve disposed in said high pressure turbine bypass pipe, and means for reducing the quantity of the reheat steam introduced into the reheater from the superheater through the high pressure turbine bypass pipe means and for discharging an excess steam from the high pressure turbine bypass pipe means and the cold reheat steam pipe when the high pressure turbine bypass means is operated.

2. A reheat steam turbine power plant as claimed in claim 1, wherein the low pressure portion is the condenser and the reducing and discharge means comprises a steam discharge pipe branching off a dowstream portion of the check valve means in the cold reheat steam pipe and connected to the condenser, a regulation valve disposed in the steam discharge pipe, and a controller means for controlling an opening of the turbine bypass valve and the regulation valve.

3. A reheat steam turbine power plant as claimed in claim 1, wherein the reheater comprises a first reheater and a second reheater, the reheat steam turbine comprises a first reheat steam turbine driven by a reheat steam heated up in the first reheater and a second reheat steam turbine driven by another reheat steam heated up in the second reheater, the cold reheat steam pipe comprises a first cold reheat steam pipe means for connecting an outlet of the high pressure steam turbine with the inlet of the first reheater and a second cold reheat steam pipe means for connecting the outlet of the first reheat steam turbine with the inlet of the second reheater, and wherein the reducing and discharging means comprises first high pressure turbine bypass means for connecting the main steam pipe with the first cold reheat steam pipe and a second high pressure turbine bypass pipe means for connecting the main steam pipe with the second cold reheat steam pipe, and the turbine bypass valve comprises a first high pressure turbine bypass valve disposed in the first high pressure bypas pipe controlled by a controller means and a second high pressure turbine bypass valve disposed in the second high pressure bypass pipe controlled by the controller means.

4. A reheat steam turbine power plant as claimed in claim 3, wherein the low pressure portion is the condenser and the reducing and discharge means comprises a steam discharge pipe means having a regulation valve therein for connecting at least one of the cold reheat steam pipes to the condenser, and a controller means for controlling opening of the high pressure turbine bypass valves and the regulation valves.

5. A reheat steam turbine power plant with a turbine bypass system, the power plant comprising: a boiler having a superheater, a first reheater and a second reheater, a high pressure steam turbine driven by a steam generated in the superheater and conducted through a main steam pipe having a first control valve means, a reheat steam turbine driven by a first reheat steam heated up in the first reheater and conducted through a first hot reheat steam pipe having a second control valve, a low pressure steam turbine driven by a second reheat steam heated up in the second reheater and conducted through a second hot reheat steam pipe having a third control valve, a condenser for condensing the second reheat steam exhausted from the low pressure steam turbine, a first cold reheat steam pipe means having a first check valve means for connecting an outlet of the high pressure steam turbine with an inlet of the first reheater, a second cold reheat steam pipe means having a second check valve means for connecting an outlet of the reheat steam turbine with an inlet of the second reheater, a condensate pipe means for connecting the condenser with an upstream side of the superheater, a high pressure turbine bypass pipe having a high pressure turbine bypass valve therein for connecting the main steam pipe with the first cold reheat steam pipe, an intermediate pressure turbine bypass pipe having an intermediate pressure turbine bypass valve therein for connecting the first hot reheat steam pipe with the second cold reheat steam pipe, and means for reducing a quantity of reheat steam introduced into at least one of the reheaters through at least one of the turbine bypass pipes and for discharging an excess reheat steam from at least one of the turbine bypass pipes.

6. A reheat steam turbine power plant as claimed in claim 5, wherein the reducing and discharging means comprises at least one steam discharge pipe branching off a downstream portion of the check valve means in the cold-heat steam pipes and connected to the condenser, at least one regulation valve provided in the steam discharge pipes, and a controller means for controlling an opening of the turbine bypass valves and the at least one regulation valve.

* * * * *